US006095774A

United States Patent [19]

Tanaka et al.

[11] Patent Number: 6,095,774

[45] Date of Patent: Aug. 1, 2000

[54] HIGH-PRESSURE FUEL PUMP ASSEMBLY

[75] Inventors: Katsunori Tanaka; Masayasu Miyajima; Yoshihiko Onishi; Tatsuya Ikegami, all of Tokyo, Japan

[73] Assignee: Mitsubishi Denki Kabushiki Kaisha, Tokyo, Japan

[21] Appl. No.: 09/257,302

[22] Filed: Feb. 25, 1999

[30] Foreign Application Priority Data

Jul. 29, 1998 [JP] Japan ..... 10-213800

[51] Int. Cl.[7] ..... F04B 11/00

[52] U.S. Cl. ..... 417/540

[58] Field of Search ..... 417/540

[56] References Cited

U.S. PATENT DOCUMENTS

| | | | |
|---|---|---|---|
| 5,244,364 | 9/1993 | Laco et al. | 417/534 |
| 5,731,515 | 3/1998 | Tominaga et al. | 73/119 A |
| 5,918,578 | 7/1999 | Oda | 123/456 |

FOREIGN PATENT DOCUMENTS 9-32617 2/1997 Japan .

*Primary Examiner*—Teresa Walberg
*Assistant Examiner*—Vinod D Patel
*Attorney, Agent, or Firm*—Sughrue, Mion, Zinn, Macpeak & Seas, PLLC

[57] ABSTRACT

The present invention relates to a high-pressure fuel pump assembly 200, which supplies high-pressure fuel from a fuel supply port 9 to a delivery pipe 1*a*, wherein the high-pressure fuel pump assembly 200 comprises: a high-pressure pump 20 having an intake valve 22 and a discharge valve 21; a fuel discharge passage 4 connecting the discharge valve 21 to the fuel supply port 9; and a high-pressure damper 60 disposed in the fuel discharge passage 4; and a first check valve 210, which opens when the pressure on the voluminous chamber side is a fixed value lower than the pressure on the discharge valve side, is provided within the fuel discharge passage 4 between the high-pressure damper 60 and the discharge valve 21. The first check valve may be a ball valve or a reed valve, and a second check valve may be provided between the fuel supply port 9 and the high-pressure damper 60. The cross-sectional area of the fuel discharge passage 4 may be equal to or greater than the cross-sectional area of the fuel outlet 4*a* along the entire length of the fuel discharge passage 4.

20 Claims, 13 Drawing Sheets

HIGH-PRESSURE FUEL PUMP ASSEMBLY

BACKGROUND OF THE INVENTION

1. Field of the Invention

The present invention relates to a high-pressure fuel pump assembly mainly for use in a cylinder-injected engine, etc.

2. Description of the Related Art

Engines in which fuel is injected into the engine cylinder, the so-called "cylinder-injected" or "direct injection engines", are known among both diesel engines and gasoline engines. Cylinder-injected engines of this kind demand that sufficiently high fuel injection pressure be provided and also demand that fuel pressure surges be minimized to ensure stable injection. To these ends, compact single-cylinder high-pressure fuel pumps have been proposed which are of simple construction and inexpensive to manufacture.

FIG. 12 is a block diagram showing the layout of a high-pressure fuel pump assembly 100 to which the present invention can be applied. In FIG. 12, a delivery pipe 1*a* supplies fuel to fuel injection valves 1, which inject fuel into each of the engine cylinders (not shown). This fuel is supplied to the high-pressure fuel pump assembly 100 through a low-pressure fuel supply passage 5 from a fuel tank (not shown) by means of a low-pressure fuel pump (not shown). The main component parts of the high-pressure fuel pump assembly 100 include: a low-pressure damper 13; a high-pressure fuel pump 20; a high-pressure damper 60; and a check valve 70. The high-pressure fuel pump 20 comprises: a reed valve assembly 30 having an intake valve 22 disposed in a fuel inlet 5*a* and a discharge valve 21 disposed in a fuel outlet 4*a;* and a high-pressure fuel pump main body portion 23. The check valve 70 opens when the pressure of the fuel on the fuel supply port 9 side, which connects to the delivery pipe 1*a* of the high-pressure fuel pump assembly 100, is lower than the pressure of the fuel on the high-pressure damper 60 side.

Fuel pressure surges in the fuel which is supplied to the high-pressure fuel pump assembly 100 through the low-pressure fuel supply passage 5 are absorbed by the low-pressure damper 13, the fuel is pressurized by the high-pressure fuel pump assembly 100, surges in the pressurized fuel are absorbed by the high-pressure damper 60, and the fuel passes through the check valve 70 and is supplied to the delivery pipe 1*a* from the fuel supply port 9. A passage 10 connecting to a high-pressure regulator (not shown) is disposed between the fuel supply port 9 and the delivery pipe 1*a*.

A cross-section of the construction of the high-pressure fuel pump assembly 100 is shown in FIG. 13. An enlarged cross-section of the region surrounded by the dot-and-dash line in FIG. 13 is shown in FIG. 14.

In FIG. 13, a cylindrical recessed portion 40*a* is formed in the casing 40 of the high-pressure fuel pump assembly 100. A high pressure fuel pump 20, which comprises a reed valve assembly 30 and a high-pressure fuel pump main body portion 23, is disposed in the recessed portion 40*a*.

The high-pressure fuel pump 20 is constructed by arranging the reed valve assembly 30 and the high-pressure fuel pump main body portion 23 one on top of the other from the bottom portion 40*b* of the casing 40.

Details of the reed valve assembly 30 in the high-pressure fuel pump 20 are shown in FIG. 14.

The reed valve assembly 30 comprises two plates 31, 33 and a thin valve plate 32 sandwiched between the two plates 31, 33. The plate 31 side of the reed valve assembly 30 is disposed in contact with the bottom portion 40*b,* and two adjoining passages are formed in each of the two plates 31, 33 to allow fuel to pass through. Two of the passages in the plates 31, 33 have larger cross-sections than their adjoining counterpart passages so that the valves in the valve plate 32, namely the intake valve body 32*a* and the discharge valve body 32*b,* each operate in one direction only as shown by the broken lines in the figure. The adjoining counterpart passages respectively form a fuel inlet 5*a,* which stops the backward motion of the intake valve body 32*a* and supplies fuel to the high-pressure fuel pump 20, and a fuel outlet 4*a,* which stops the backward motion of the discharge valve 32*b* and supplies fuel to the fuel discharge passage 4 from the high-pressure fuel pump main body portion 23.

The high-pressure fuel pump main body portion 23 is disposed in contact with the reed valve assembly 30.

A sleeve 41 and a fuel pressurizing chamber 45, which is surrounded by a piston 43 slidably inserted into the sleeve 41, are formed in the high-pressure fuel pump main body portion 23.

Cylindrical recesses are formed in both ends of the piston 43. A coil-shaped spring 36, which pushes the piston 43 downwards in the direction which expands the fuel pressurizing chamber 45, is disposed in a compressed condition between a spring holder 37 and the piston 43 in the recess in the reed valve assembly 30 end of the piston 43 to draw fuel in. A tappet 46 is secured in the recess in the other end of the piston 43 so as to be able to rotate freely. The tappet 46 is in contact with a cam 48, which drives the high-pressure fuel pump. The cam 48 is part of a camshaft of an engine (not shown), or is disposed on the same axis thereto, and the camshaft moves together with a crankshaft of the engine to complete one revolution for every two revolutions of the crankshaft, the piston 43 reciprocating according to the profile of the cam 48. The volume of the fuel pressurizing chamber 45 is changed by the reciprocation of the piston 43, and pressurized fuel is discharged to the fuel discharge passage 4.

A drainage chamber 52, which holds fuel which leaks out from the fuel pressurizing chamber 45 through the sliding portion 51 between the sleeve 41 and the piston 43, is formed between the sleeve 41 and a housing 42. The fuel which leaks out into the drainage chamber 52 is returned to the fuel tank (not shown) by means of a drainage passage 8 and a check valve 11, which is shown in FIG. 12. A metal bellows 53, which follows the reciprocation of the piston 43 and seals in the fuel which leaks out into the drainage chamber 52, is secured by welding to the end of the housing 42. The other end of the bellows 53 is welded to a cap 54, which is airtightly secured to the piston.

The reed valve assembly 30 and sleeve 41 are fastened to the cylindrical recessed portion 40*a* of the casing 40 by a threaded bush 35 by means of the housing 42. A seal is formed between the casing 40 and the housing 42 by means of an O-ring 55 to prevent fuel from leaking outside. A bracket 57 is disposed on the outside of the housing 42 and is sealed by an O-ring 56.

A recessed portion 40*c* is formed in the housing 40. A high-pressure damper 60 is fastened into this recessed portion 40*c*. High-pressure gas is enclosed in a space in the high-pressure damper 60, which is sealed by a thick substantially-cylindrical case 61 and a thin disk-shaped metal diaphragm 62. The metal diaphragm 62 moves to equalize the pressure of the high-pressure gas and the pressure of the fuel which flows from the fuel discharge passage 4 into a damper chamber 64, which is surrounded by the metal diaphragm 62 and a plate 63. The volume of the damper chamber 64 is thereby changed, absorbing pressure surges in the fuel in the fuel discharge passage 4.

A check valve 70, which opens when the pressure in the fuel on the delivery pipe 1*a* side is lower than the pressure of the fuel on the high-pressure fuel pump assembly side, is disposed in the fuel discharge passage 4 between the high-pressure damper 60 and the fuel supply port 9. The check valve 70 is provided to maintain the fuel within the delivery pipe 1*a* at high pressure even when the engine is stopped and to improve the starting of the engine.

The check valve 70 comprises: a plate 71; a housing 72; a spring 73; an O-ring 74; a spherical valve body 75; and a valve seat 76. The valve seat 76 has a tapered portion in the end of a cylindrical opening, which is a fuel passage, and the valve body 75, which is pressed by a coil spring 73, seals this tapered portion, closing the fuel discharge passage 4. The spring 73 is positioned by means of the housing 72 by engaging and fastening the thread on plate 71 in the thread in the casing 40, and imparts a fixed spring load to the valve body 75. The O-ring 74 is disposed between the casing 40 and housing 72 to prevent fuel from leaking outside.

During the discharge stroke, the discharge valve body 32*b* in the reed valve assembly 30 opens and the high-pressure pump 20 discharges fuel, then the high-pressure pump 20 enters its intake stroke and the pressure in the fuel pressurizing chamber 45 decreases while the intake valve body 32*a* is still open. At this time, a back flow of fuel occurs due to the difference in pressure between the high-pressure fuel on the high-pressure damper 60 side of the discharge valve 21 and the fuel on the depressurized fuel pressurizing chamber 45 side. The greater the volume of the portion between the discharge valve 21 and the check valve 70 which is filled with fuel, that is to say, the greater the combined volume of the high-pressure damper 60 and the fuel discharge passage 4, the smaller the decrease in fuel pressure on the high-pressure damper 60 side of the discharge valve 21 due to back flow, that is to say, the greater the difference between the fuel pressure on the high-pressure damper 60 side of the discharge valve 21 and the fuel pressure on the depressurized fuel pressurizing chamber 45 side, and the amount of back flow therefore increases, reducing the discharge flow efficiency (volumetric efficiency).

This reduction in discharge flow efficiency is particularly noticeable when a high fuel temperature is required to keep the discharge pressure high and when the discharge pressure is raised because the viscosity of the fuel decreases. Also, if the cross-sectional area of the fuel discharge passage 4 is small, the flow of the fuel is choked and the fuel cannot flow through the passage sufficiently, and therefore the loss of pressure is great and the maximum pressure in the high-pressure pump 20 is increased, further reducing the discharge flow efficiency. In addition, when the discharge pressure of the high-pressure pump 20 is increased in this way, the load on the cam 48 which drives the high-pressure pump is also increased, increasing the amount of friction at the surface where the cam 48 is in contact with the tappet 46. Furthermore, if the discharge pressure of the high-pressure pump 20 is increased, the amount of fuel which leaks into the drainage chamber 52 from the sliding portion 51 between the sleeve 41 and the piston 43 also increases and the flow of fuel is poor where the cross-sectional area of the passage between the sleeve 41 and the housing 42 is small, giving rise to surges in pressure within the metal bellows 53 as the piston 43 reciprocates, reducing the durability of the metal bellows 53.

SUMMARY OF THE INVENTION

The present invention aims to solve the above problems and an object of the present invention is to provide a high-pressure fuel pump assembly which has high discharge flow efficiency, minimizes friction on the cam which drives the high-pressure fuel pump, and improves the durability of the metal bellows.

The high-pressure fuel pump assembly according to the present invention is characterized in that, in a high-pressure fuel pump assembly which supplies high-pressure fuel from a fuel supply port to a delivery pipe, the high-pressure fuel pump assembly comprises:

a high-pressure pump having an intake valve disposed in a fuel inlet and a discharge valve disposed in a fuel outlet;

a fuel discharge passage connecting the discharge valve to the fuel supply port; and a voluminous chamber disposed in the fuel discharge passage, which absorbs surges in the fuel;

wherein a first check valve, which opens when the pressure on the voluminous chamber side is lower than the pressure on the discharge valve side, is provided within the fuel discharge passage between the voluminous chamber and the discharge valve.

The high-pressure fuel pump assembly according to the present invention is also characterized in that the first check valve may be a ball valve.

The high-pressure fuel pump assembly according to the present invention is also characterized in that the first check valve may be a reed valve.

The high-pressure fuel pump assembly according to the present invention is also characterized in that a second check valve may be provided within the fuel discharge passage between the fuel supply port and the voluminous chamber.

The high-pressure fuel pump assembly according to the present invention is also characterized in that the voluminous chamber may be a high-pressure damper.

The high-pressure fuel pump assembly according to the present invention is also characterized in that the voluminous chamber may be a resonator.

The high-pressure fuel pump assembly according to the present invention is also characterized in that the voluminous chamber may consist only of a voluminous portion having a fixed volume.

The high-pressure fuel pump assembly according to the present invention is also characterized in that the cross-sectional area of the fuel discharge passage may be equal to or greater than the cross-sectional area of the fuel outlet along the entire length of the fuel discharge passage.

DETAILED DESCRIPTION OF THE PREFERRED EMBODIMENTS

Embodiment 1

Figure 1:
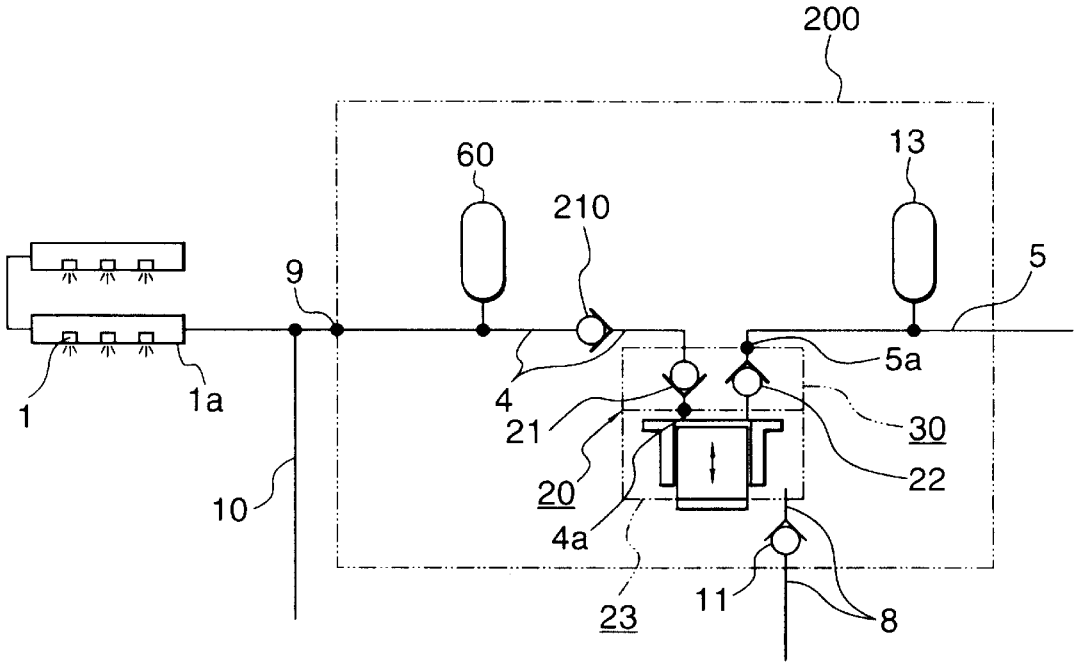
FIG. 1 is a block diagram showing the layout of a high-pressure fuel pump assembly according to Embodiment 1 of the present invention.
Figure 2:
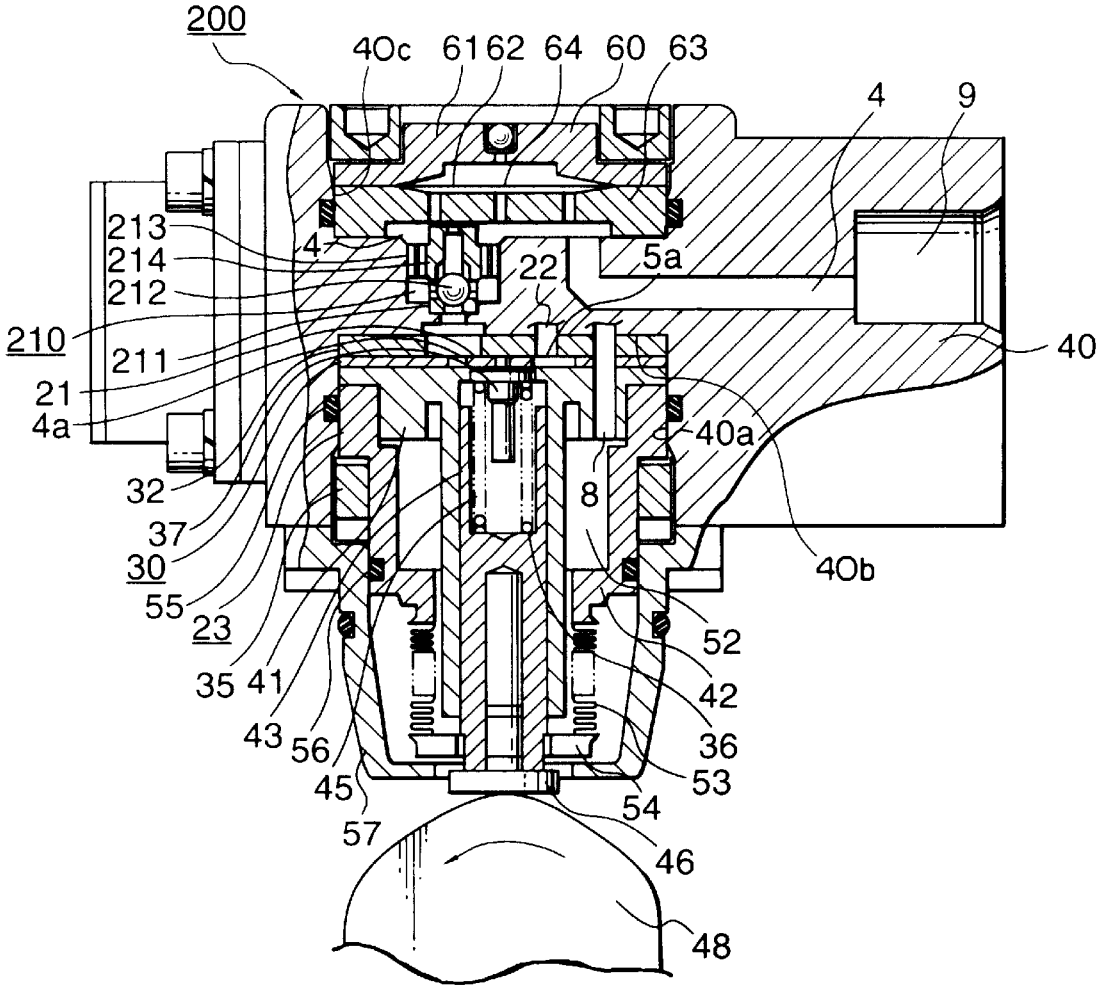
FIG. 2 is a cross-section showing the construction of the high-pressure fuel pump assembly according to Embodiment 1 of the present invention.
Figure 13:
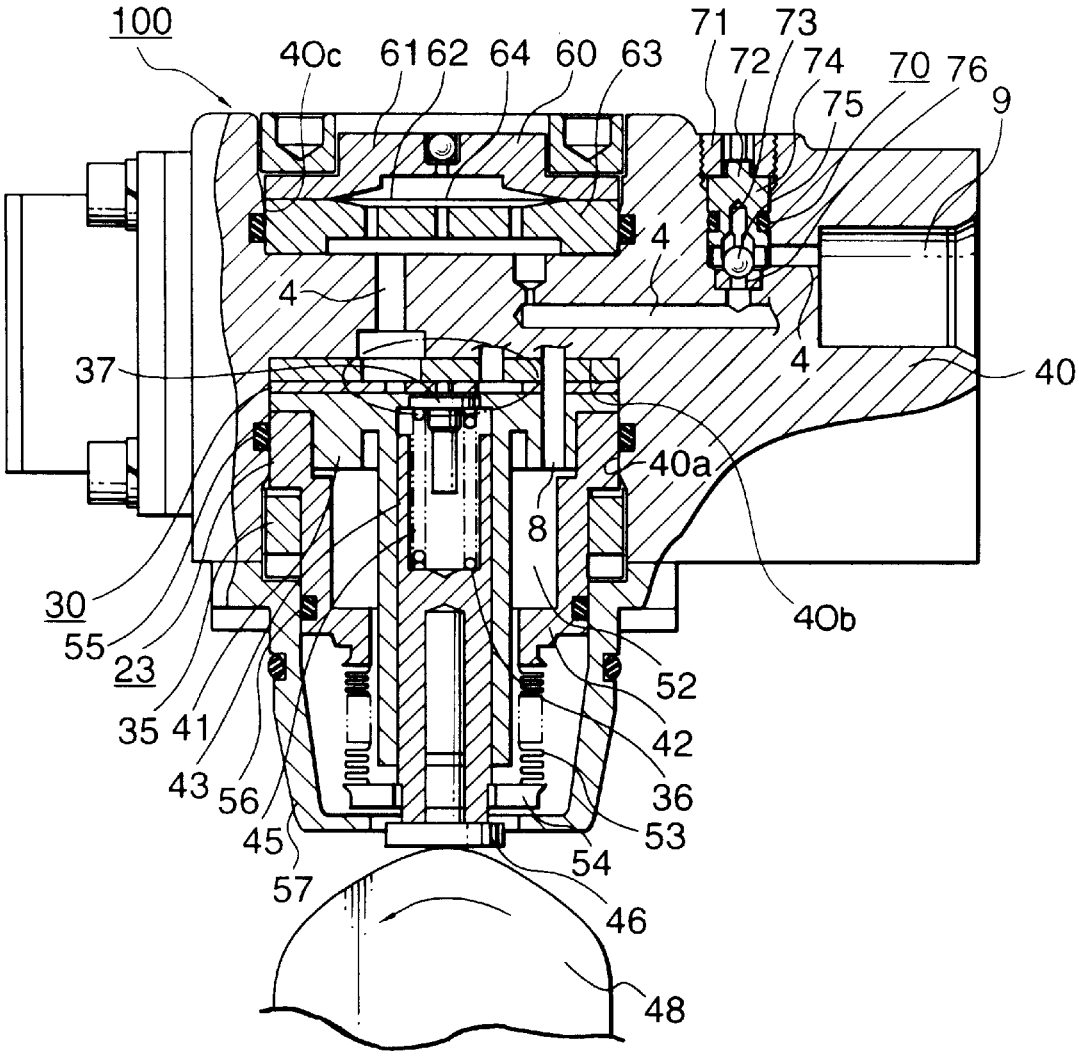
FIG. 13 is a cross-section showing the construction of the conventional high-pressure fuel pump assembly.
Figure 14:
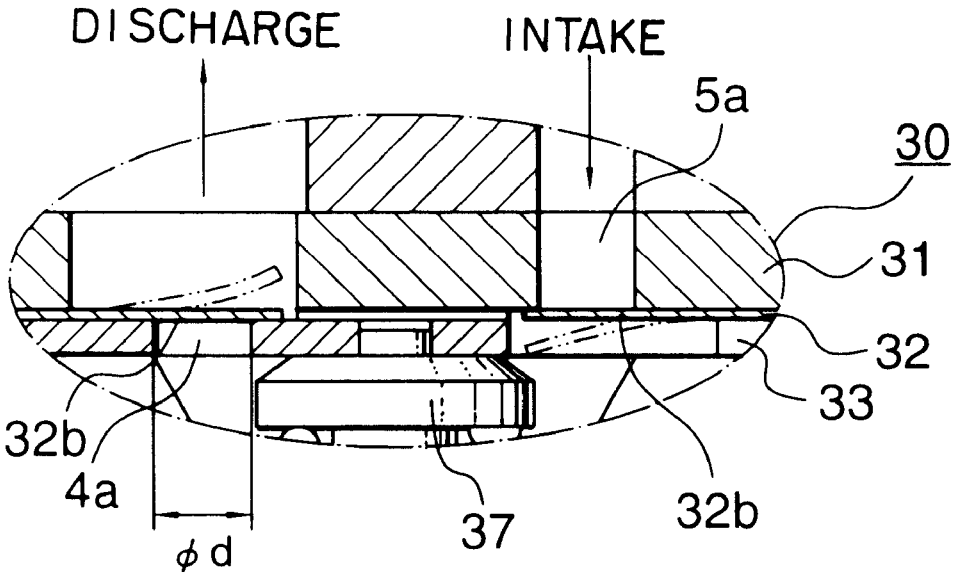
FIG. 14 is a cross-section showing the construction of a reed valve assembly used in the conventional high-pressure fuel pump assembly.

FIG. 1 is a block diagram showing the layout of a high-pressure fuel pump assembly 200 which is an embodiment of the present invention. FIG. 2 is a cross-section of the high-pressure fuel pump assembly 200. In the figures, parts and components which are the same as or equivalent to those of the conventional example in FIGS. 12 to 14 have been given identical numerals and duplicate explanations have been omitted.

Figure 12:
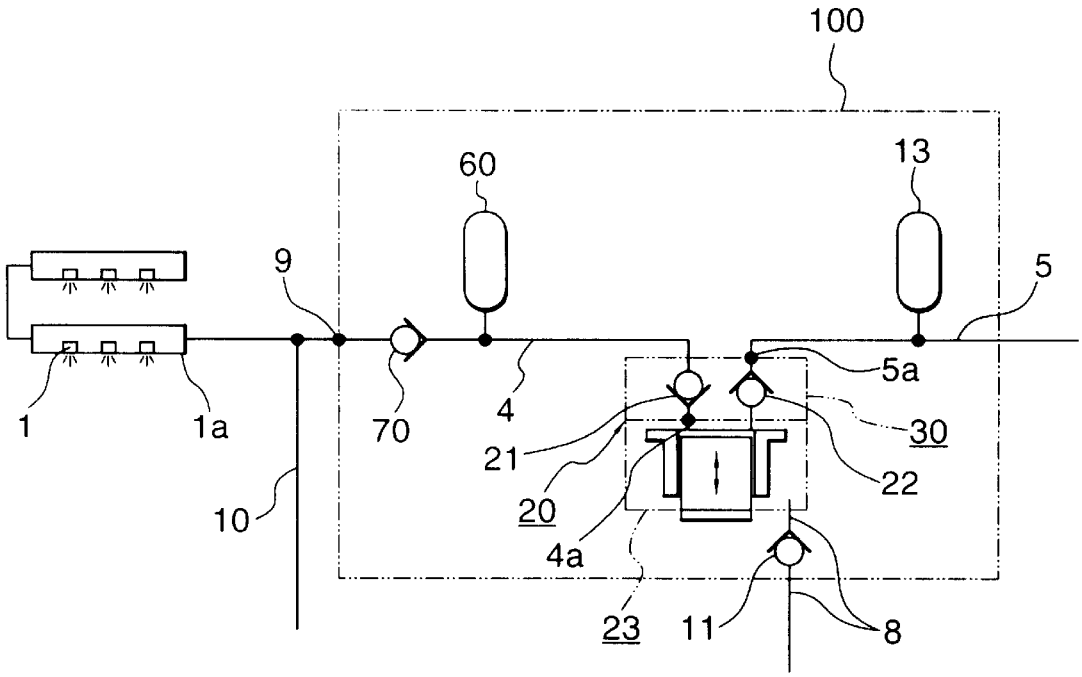
FIG. 12 is a block diagram showing the layout of a conventional high-pressure fuel pump assembly.

The high-pressure fuel pump assembly 200 in FIG. 1 differs from the high-pressure fuel pump assembly 100 in FIG. 12 in that, instead of the check valve 70, a first check valve 210 is disposed downstream from the discharge valve 21 disposed in the fuel outlet 4*a* and upstream from the high-pressure damper 60.

That is to say, the high-pressure fuel pump assembly 200, which supplies high-pressure fuel from a fuel supply port 9 to a delivery pipe 1*a,* comprises:

- a high-pressure pump 20 having an intake valve 22 disposed in a fuel inlet 5*a* and a discharge valve 21 disposed in a fuel outlet 4*a;*
- a fuel discharge passage 21 connecting the discharge valve 21 to the fuel supply port 9; and
- a high-pressure damper 60 disposed in the fuel discharge passage 4, which has a voluminous chamber which absorbs surges in the fuel;
- wherein a first check valve 210 is disposed within the fuel discharge passage 4 between the high-pressure damper 60 and the discharge valve 21. The first check valve 210 opens when the pressure on the high-pressure damper 60 side is lower than the pressure on the discharge valve 21 side.

The construction of the high-pressure fuel pump assembly provided with the first check valve is shown in FIG. 2. In the figure, the first check valve 210, which is a ball valve, is disposed in the fuel discharge passage 4 between the fuel outlet 4*a* of the reed valve assembly 30 and the high-pressure damper 60.

Figure 3:
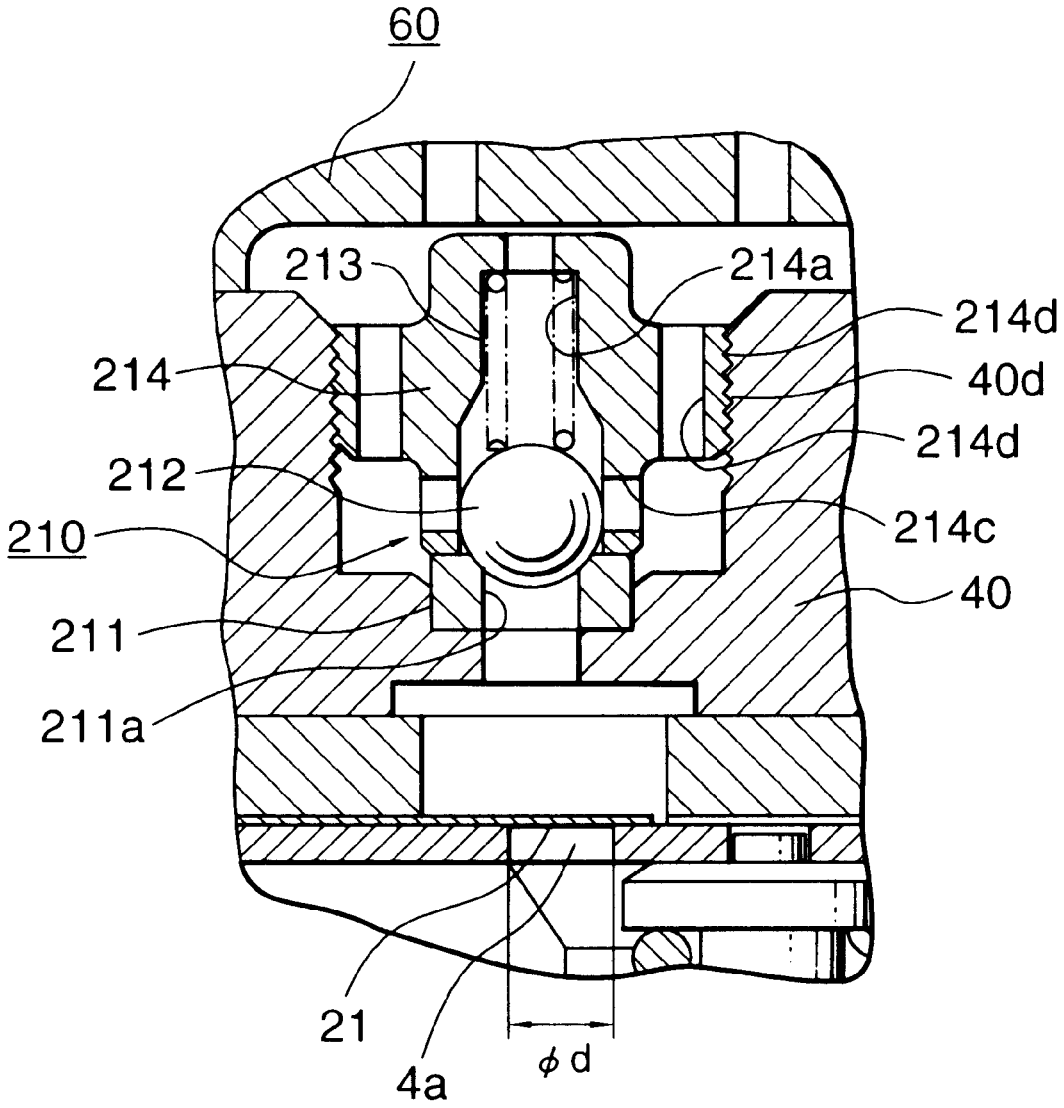
FIG. 3 is a cross-section showing the construction of a first check valve according to Embodiment 1 of the present invention.

The first check valve 210 comprises: a valve sheet 211; a spherical valve body 212; a spring 213; and a housing 214. FIG. 3 is an enlarged cross-section showing the construction of the first check valve. In the figure, the hollow substantially-cylindrical valve sheet 211 has an inner cylindrical aperture 211*a,* which forms a fuel passage, the valve sheet 211 is secured to the casing 40. The valve sheet 211 has a tapered portion at one end of the cylindrical aperture 211*a,* and the valve body 212, which is pressed by the coil spring 213, forms a seal with this tapered portion and closes the fuel discharge passage 4. The spring 213 is inserted into a cylindrical aperture 214*a* in the housing 214 together with the valve body 212. The housing 214 has a male thread 214*b* on its outer circumferential surface which engages with a female thread 40*d* disposed in the casing 40, and the housing 214 is secured to the casing 40 so as to impart a fixed spring load to the valve body 212.

When the pressure of the fuel on the discharge valve 21 side is higher than a certain pressure determined by the pressure of the fuel on the high-pressure damper 60 side and the fixed spring load applied by the spring 213, the valve body 212 of the first check valve 210 is pushed up towards the top of FIG. 3. Fuel on the discharge valve 21 side passes through the cylindrical apertures 214*c,* 214*d* disposed in the housing 214 and is supplied to the high-pressure damper 60 side. In other words, the first check valve 210 opens when the pressure on the high-pressure damper 60 side is lower than the pressure on the discharge valve 21 side.

The cross-sectional area of the fuel discharge passage 4 is equal to or greater than the cross-sectional area of the fuel outlet 4*a,* which has a circular cross-section of diameter d, along the entire length of the fuel discharge passage 4.

Since the high-pressure fuel pump assembly according to an embodiment of the present invention has the above construction, the volume of the portion between the discharge valve 21 and the first check valve 210 which is filled with fuel can be reduced, and the decrease in fuel pressure on the high-pressure damper 60 side of the discharge valve 21 in the high-pressure fuel pump 20 due to the back flow of high-pressure fuel from the high-pressure damper 60 side of the discharge valve 21 to the fuel pressurizing chamber 45 is therefore increased, minimizing the amount of back flow and improving the discharge flow efficiency.

Also, since the cross-sectional area of the fuel discharge passage 4 is enlarged, the flow of fuel is not choked and loss of pressure in the fuel flowing in the fuel discharge passage 4 is reduced.

Furthermore, the first check valve 210 can also perform the same functions as the check valve 70 in FIG. 12, that is, to maintain the fuel within the delivery pipe 1*a* at high pressure even when the engine is stopped and to improve the starting of the engine.

Embodiment 2

Figure 4:
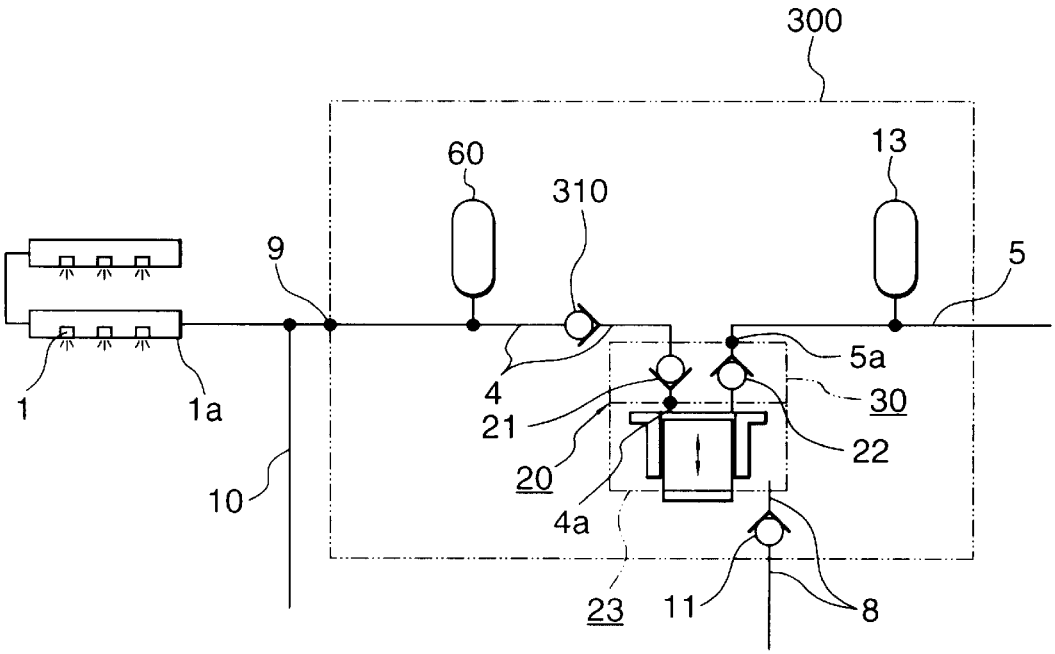
FIG. 4 is a block diagram showing the layout of a high-pressure fuel pump assembly according to Embodiment 2 of the present invention.
Figure 5:
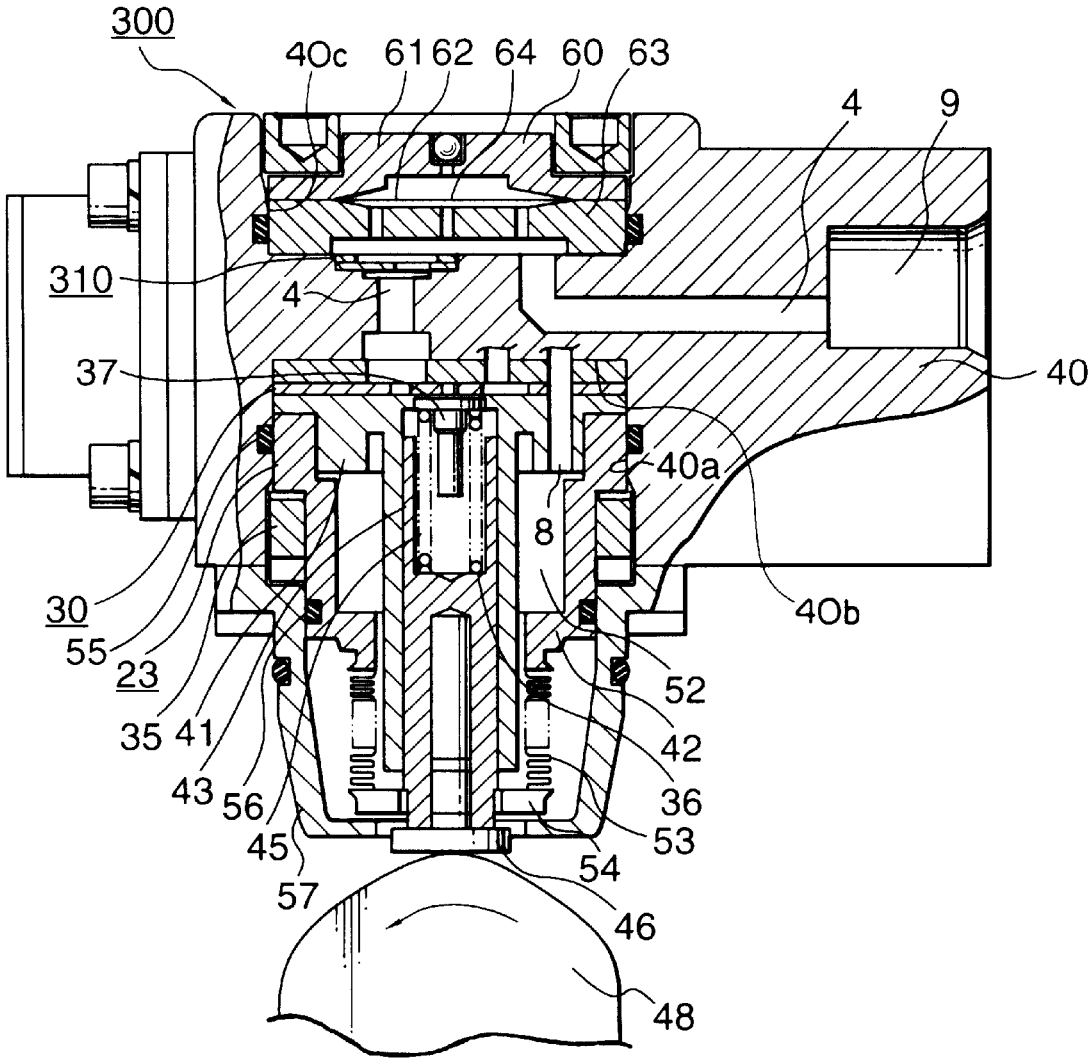
FIG. 5 is a cross-section showing the construction of the high-pressure fuel pump assembly according to Embodiment 2 of the present invention.

FIG. 4 is a block diagram showing the layout of a high-pressure fuel pump assembly 300 which is another embodiment of the present invention. FIG. 5 is a cross-section of the high-pressure fuel pump assembly 300. Since the construction of a first check valve 310 in this embodiment is the only difference from the construction of the first check valve 210 in FIGS. 1 and 2, explanation of the parts in common with FIGS. 1 and 2 will be omitted.

In FIG. 4, the first check valve 310 differs from the first check valve 210 in FIG. 1 in that the first check valve 310 is a reed valve, and the construction of the high-pressure fuel pump assembly 300 provided with the first check valve 310 is shown in FIG. 5.

Figure 6:
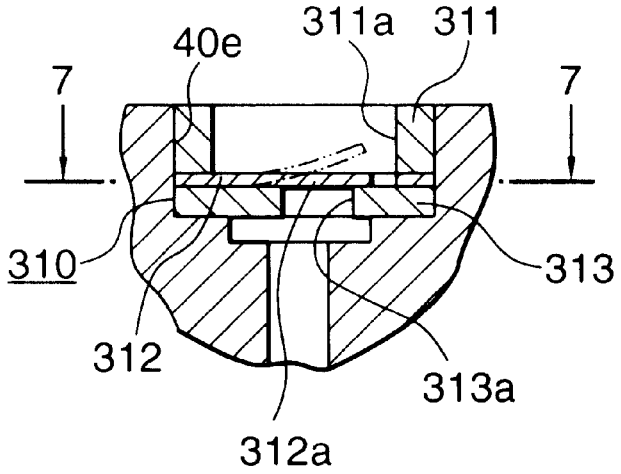
FIG. 6 is a cross-section showing the construction of a first check valve according to Embodiment 2 of the present invention.
Figure 7:
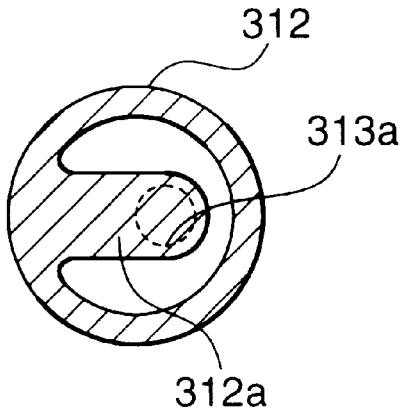
FIG. 7 is a cross-section taken along line 7—7 in FIG. 6.

In FIG. 5, the first check valve 310, which is a reed-type valve, is disposed downstream from the discharge valve 21 disposed in the fuel outlet 4*a* and upstream from the high-pressure damper 60. Details of the reed-type check valve 310 are shown in FIGS. 6 and 7. FIG. 6 is a detailed enlargement of the check valve in FIG. 5, and FIG. 7 is a cross-section taken along line VII—VII in FIG. 6.

In FIG. 6, the check valve is composed of two disk-shaped plates 311, 313 and a thin valve plate 312 sandwiched between the two plates 311, 313. The check valve 310 is inserted into a recess 40*e* in the casing 40 and secured to the casing 40 by crimping the plate 311 and the casing 40 around the outer circumference of the plate 311. Adjoining passages 311*a*, 313*a* are formed in the plates 311, 313 to allow fuel to pass through. The passage 311*a* in the plate 311 has a larger cross-section than the adjoining counterpart passage 313*a* in the plate 313, so that the valve body 312*a* in the valve plate 312 operates in one direction only as shown by the broken lines in the figure.

In FIG. 5, when the pressure of the fuel on the discharge valve 21 side is higher than the pressure of the fuel on the high-pressure damper 60 side, the valve body 312*a* of the first check valve 310 is pushed up towards the top of the figure, and fuel on the discharge valve 21 is supplied to the high-pressure damper 60 side.

Embodiment 3

Figure 8:
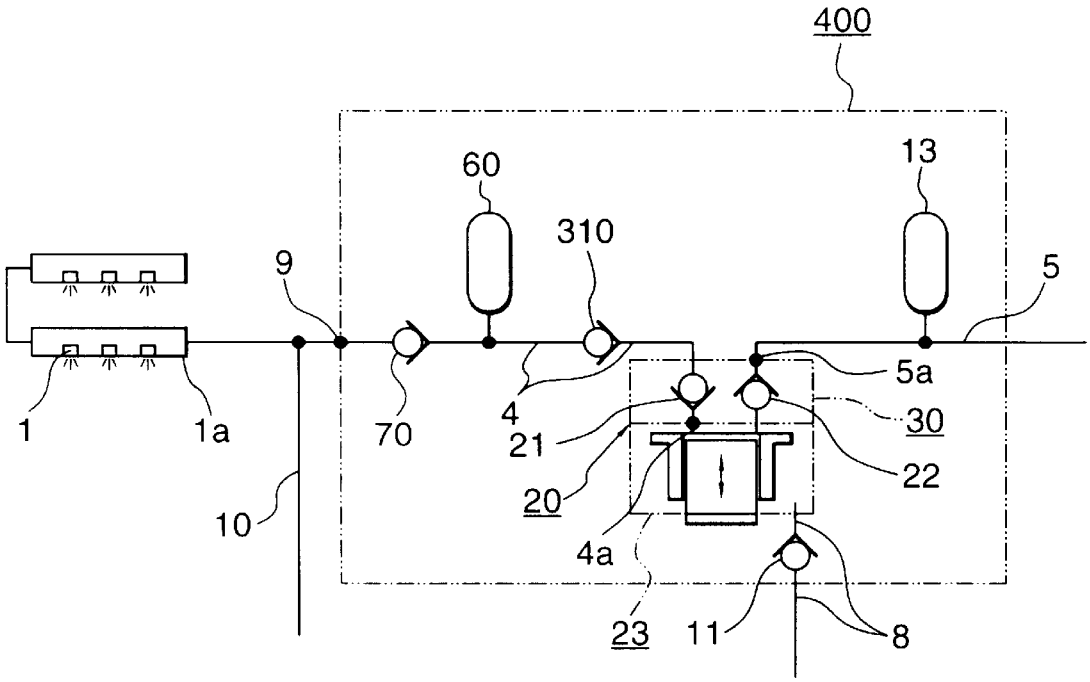
FIG. 8 is a block diagram showing the layout of a high-pressure fuel pump assembly according to Embodiment 3 of the present invention.
Figure 11:
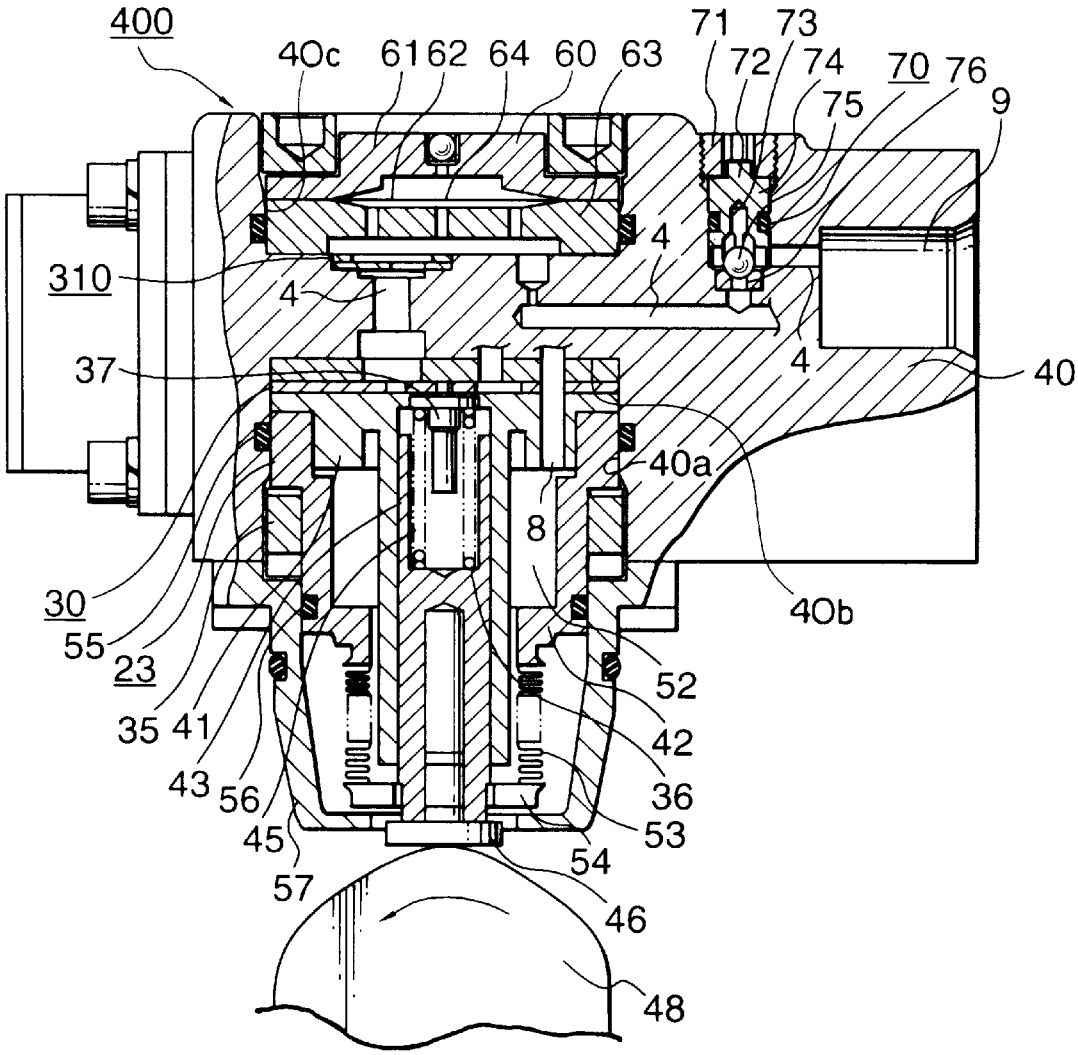
FIG. 11 is a cross-section showing the construction of the high-pressure fuel pump assembly according to Embodiment 3 of the present invention.

FIG. 8 is a block diagram showing the layout of a high-pressure fuel pump assembly 400 which is another embodiment of the present invention. FIG. 11 is a cross-section of the high-pressure fuel pump assembly 400. In this embodiment, a check valve 70 has been added to FIG. 4 as a second check valve 210 and explanation of the parts in common with FIG. 4 will be omitted.

A reed-type check valve 310, like that in FIG. 5, is disposed in the fuel discharge passage 4, and a check valve 70, which is a second check valve which opens when the pressure of the fuel on the delivery pipe 1*a* side is lower than the pressure of the fuel on the high-pressure fuel pump assembly side, is disposed between the high-pressure damper 60 and the fuel supply port 9. The check valve 70 is provided to maintain the fuel within the delivery pipe 1*a* at high pressure even when the engine is stopped and to improve the starting of the engine.

Moreover, as a variation of the high-pressure fuel pump assembly 400 which is an embodiment of the present invention, the ball-type first check valve 210 shown in FIG. 2 may be used instead of the reed-type first check valve 310.

Figure 9:
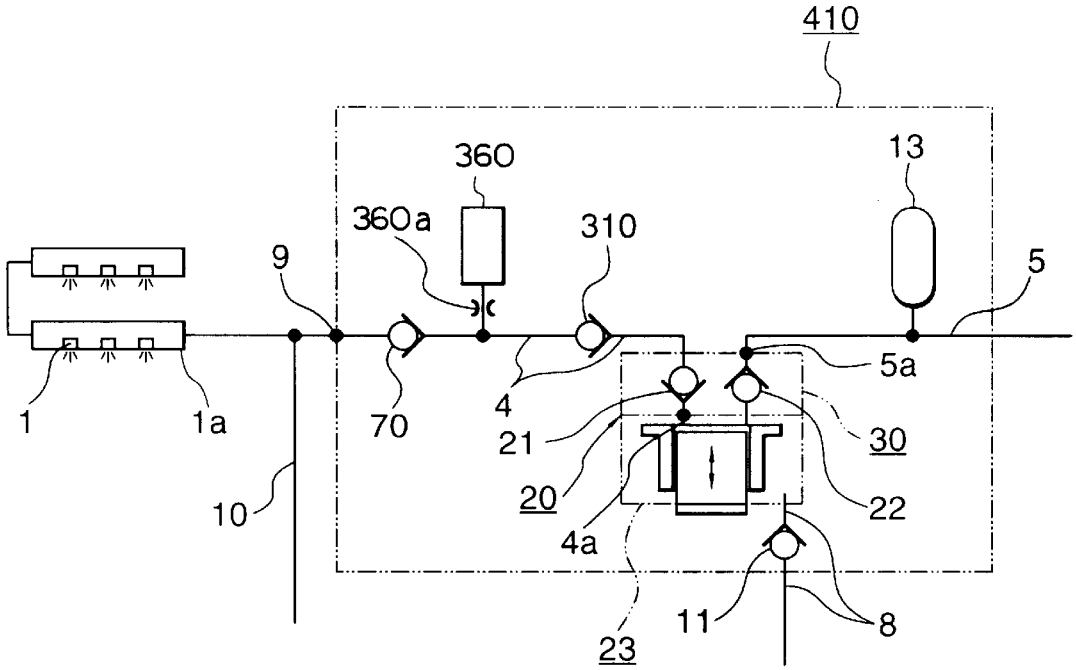
FIG. 9 is a block diagram showing the layout of a variation of a high-pressure fuel pump assembly according to Embodiments 1 to 3 of the present invention.

Furthermore, in the high-pressure fuel pump assembly according to the present invention, the voluminous chamber which absorbs surges in the fuel should not be limited to a high-pressure damper 60, and may be a resonator 360 as in the high-pressure fuel pump assembly 410 shown in FIG. 9. Since the resonator 360 comprises an orifice 360*a* having a fixed cross-sectional area and a voluminous portion having a fixed volume, the resonator 360 absorbs surges in the fuel having particular resonance points.

Figure 10:
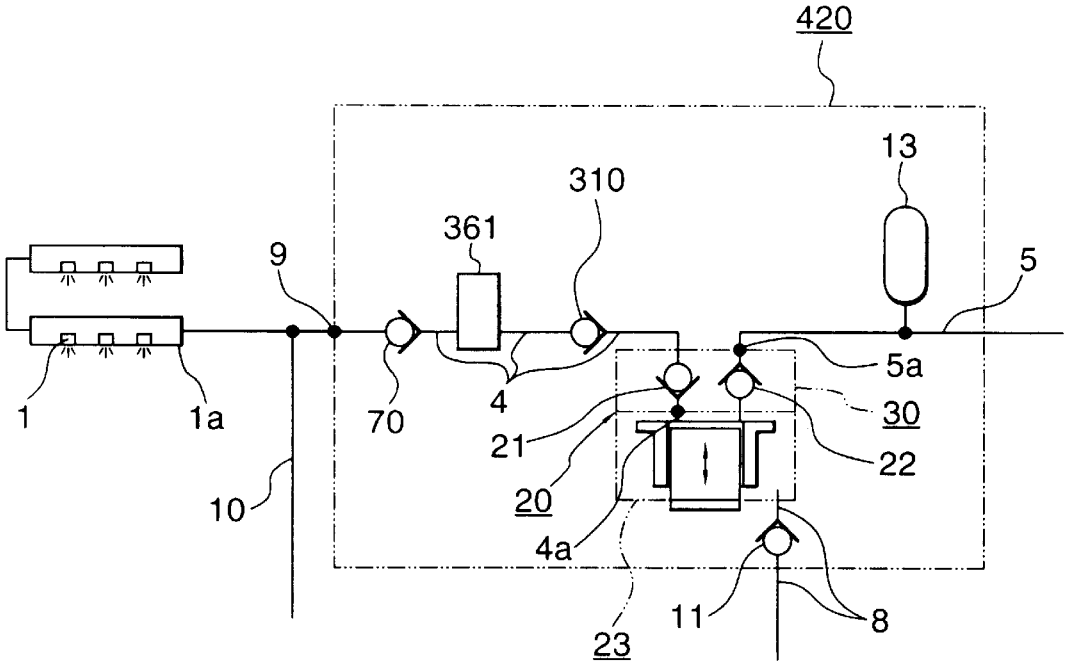
FIG. 10 is a block diagram showing the layout of another variation of a high-pressure fuel pump assembly according to Embodiments 1 to 3 of the present invention.

Still furthermore, in the high-pressure fuel pump assembly according to the present invention, the voluminous chamber which absorbs surges in the fuel should not be limited to a variable voluminous chamber, such as a high-pressure damper 60, or a chamber having an orifice 360*a*, such as a resonator 360, and may consist only of a voluminous portion 361 having a fixed volume as in the high-pressure fuel pump assembly 420 shown in FIG. 10.

According to the high-pressure fuel pump assembly of the present invention, a high-pressure fuel pump assembly which supplies high-pressure fuel from a fuel supply port to a delivery pipe comprises:

a high-pressure pump having an intake valve disposed in a fuel inlet and a discharge valve disposed in a fuel outlet;

a fuel discharge passage connecting the discharge valve to the fuel supply port; and a voluminous chamber disposed in the fuel discharge passage, which absorbs surges in the fuel;

wherein a first check valve, which opens when the pressure on the voluminous chamber side is lower than the pressure on the discharge valve side, is provided within the fuel discharge passage between the voluminous chamber and the discharge valve. Thus, the decrease in fuel pressure on the voluminous chamber side of the discharge valve in the high-pressure fuel pump due to the back flow of high-pressure fuel from the voluminous chamber side of the discharge valve to the fuel pressurizing chamber is increased, minimizing the amount of back flow and improving the discharge flow efficiency.

Reduction in discharge flow efficiency is prevented, particularly when the fuel temperature is high and when the discharge pressure is raised.

According to the high-pressure fuel pump assembly of the present invention, the first check valve may be a ball valve. Thus, the back flow of fuel from the voluminous chamber side to the discharge valve side is made more difficult, and the functions of maintaining the fuel within the delivery pipe l*a* at high pressure even when the engine is stopped and improving the starting of the engine can also be performed.

According to the high-pressure fuel pump assembly of the present invention, the first check valve may be a reed valve. Thus, the construction is simple compared to the ball valve and is compact in size, and the discharge flow efficiency of the high-pressure fuel pump is improved.

According to the high-pressure fuel pump assembly of the present invention, a second check valve may be provided within the fuel discharge passage between the fuel supply port and a voluminous chamber. Thus, the discharge flow efficiency of the high-pressure fuel pump is improved by the first check valve, and the fuel within the delivery pipe 1*a* is maintained at high pressure even when the engine is stopped and the starting of the engine is improved by the second check valve.

According to the high-pressure fuel pump assembly of the present invention, the voluminous chamber may be a high-pressure damper. Thus, the discharge flow efficiency of the high-pressure fuel pump can be improved and surges in the pressure of the fuel can be absorbed.

According to the high-pressure fuel pump assembly of the present invention, the voluminous chamber may be a resonator. Thus, the discharge flow efficiency of the high-pressure fuel pump can be improved and surges in the pressure of the fuel can be absorbed.

According to the high-pressure fuel pump assembly of the present invention, the voluminous chamber may consist only of a voluminous portion having a fixed volume. Thus, the discharge flow efficiency of the high-pressure fuel pump can be improved, the construction is simple, and surges in the pressure of the fuel can be absorbed.

According to the high-pressure fuel pump assembly of the present invention, the cross-sectional area of the fuel discharge passage may be equal to or greater than the cross-sectional area of the fuel outlet along the entire length of the fuel discharge passage. Thus, the flow of fuel is not choked and loss of pressure in the fuel flowing in the fuel discharge passage is reduced. Also, since the maximum pressure in the high-pressure fuel pump is not increased, the load on the cam which drives the high-pressure fuel pump is reduced, reducing the amount of friction at the surface where the cam is in contact with the tappet. Furthermore, since the maximum pressure in the high-pressure fuel pump is not increased, the amount of fuel which leaks into the drainage chamber from the sliding portion between the sleeve and the piston, and the occurrence of surges in pressure within the metal bellows are both reduced, improving the durability of the metal bellows.

What is claimed is:

1. A high-pressure fuel pump assembly which supplies high-pressure fuel from a fuel supply port to a delivery pipe, said high-pressure fuel pump assembly comprising:

a high-pressure pump having an intake valve disposed in a fuel inlet and a discharge valve disposed in a fuel outlet;

a fuel discharge passage connecting said discharge valve to said fuel supply port; and a voluminous chamber disposed in said fuel discharge passage, which absorbs surges in the fuel;

wherein a first check valve, which opens when the pressure on said voluminous chamber side is lower than the pressure on said discharge valve side, is provided within said fuel discharge passage between said voluminous chamber and said discharge valve.

2. The high-pressure fuel pump assembly according to claim 1, wherein said first check valve is a ball valve.

3. The high-pressure fuel pump assembly according to claim 2, wherein a second check valve is provided within said fuel discharge passage between said fuel supply port and said voluminous chamber.

4. The high-pressure fuel pump assembly according to claim 3, wherein said voluminous chamber is a high-pressure damper.

5. The high-pressure fuel pump assembly according to claim 4, wherein the cross-sectional area of said fuel discharge passage is equal to or greater than the cross-sectional area of said fuel outlet along the entire length of said fuel discharge passage.

6. The high-pressure fuel pump assembly according to claim 3, wherein said voluminous chamber is a resonator.

7. The high-pressure fuel pump assembly according to claim 6, wherein the cross-sectional area of said fuel discharge passage is equal to or greater than the cross-sectional area of said fuel outlet along the entire length of said fuel discharge passage.

8. The high-pressure fuel pump assembly according to claim 3, wherein said voluminous chamber consists only of a voluminous portion having a fixed volume.

9. The high-pressure fuel pump assembly according to claim 1, wherein said first check valve is a reed valve.

10. The high-pressure fuel pump assembly according to claim 9, wherein a second check valve is provided within said fuel discharge passage between said fuel supply port and said voluminous chamber.

11. The high-pressure fuel pump assembly according to claim 10, wherein said voluminous chamber is a high-pressure damper.

12. The high-pressure fuel pump assembly according to claim 11, wherein the cross-sectional area of said fuel discharge passage is equal to or greater than the cross-sectional area of said fuel outlet along the entire length of said fuel discharge passage.

13. The high-pressure fuel pump assembly according to claim 10, wherein said voluminous chamber is a resonator.

14. The high-pressure fuel pump assembly according to claim 13, wherein the cross-sectional area of said fuel discharge passage is equal to or greater than the cross-sectional area of said fuel outlet along the entire length of said fuel discharge passage.

15. The high-pressure fuel pump assembly according to claim 10, wherein said voluminous chamber consists only of a voluminous portion having a fixed volume.

16. The high-pressure fuel pump assembly according to claim 15, wherein the cross-sectional area of said fuel discharge passage is equal to or greater than the cross-sectional area of said fuel outlet along the entire length of said fuel discharge passage.

17. The high-pressure fuel pump assembly according to claim 1, wherein a second check valve is provided within said fuel discharge passage between said fuel supply port and said voluminous chamber.

18. The high-pressure fuel pump assembly according to claim 1, wherein said voluminous chamber is a high-pressure damper.

19. The high-pressure fuel pump assembly according to claim 1, wherein said voluminous chamber is a resonator.

20. The high-pressure fuel pump assembly according to claim 1, wherein said voluminous chamber consists only of a voluminous portion having a fixed volume.

* * * * *